US007784712B2

(12) United States Patent
Wang et al.

(10) Patent No.: US 7,784,712 B2
(45) Date of Patent: Aug. 31, 2010

(54) MICRO-DROPLET GENERATOR

(75) Inventors: Yu-Ran Wang, Banqiao (TW); Sheng-Chih Shen, Sinying (TW); Yi-Cheng Chen, Jhonghe (TW); Chien-Shien Yeh, Yongkang (TW); Chung-Jui Lee, Hsinchu (TW); I-Kai Pan, Sinshih Township, Tainan County (TW)

(73) Assignee: Industrial Technology Research Institute, Hsinchu (TW)

( * ) Notice: Subject to any disclaimer, the term of this patent is extended or adjusted under 35 U.S.C. 154(b) by 616 days.

(21) Appl. No.: 11/165,112

(22) Filed: Jun. 22, 2005

(65) Prior Publication Data

US 2006/0219806 A1 Oct. 5, 2006

(30) Foreign Application Priority Data

Apr. 1, 2005 (TW) ..... 94110603 A

(51) Int. Cl.
*B05B 1/08* (2006.01)

(52) U.S. Cl. ..... 239/102.2

(58) Field of Classification Search ..... 239/102.1, 239/102.2, 589.1, 590, 596; 128/200.14, 128/200.16

See application file for complete search history.

(56) References Cited

U.S. PATENT DOCUMENTS

| | | | | |
|---|---|---|---|---|
| 4,530,464 | A * | 7/1985 | Yamamoto et al. | 239/102.2 |
| 4,533,082 | A * | 8/1985 | Maehara et al. | 239/102.2 |
| 4,702,418 | A * | 10/1987 | Carter et al. | 239/101 |
| 5,152,456 | A * | 10/1992 | Ross et al. | 239/102.2 |
| 6,036,105 | A * | 3/2000 | Sanada et al. | 239/104 |
| 6,116,517 | A * | 9/2000 | Heinzl et al. | 239/101 |
| 6,296,196 | B1 * | 10/2001 | Denen et al. | 239/4 |
| 6,450,419 | B1 * | 9/2002 | Martens et al. | 239/102.1 |
| 6,969,008 | B2 * | 11/2005 | Helf et al. | 239/4 |
| 7,152,810 | B2 | 12/2006 | Gau et al. | |
| 7,178,741 | B2 | 2/2007 | Cheng-Chih et al. | |

* cited by examiner

*Primary Examiner*—Davis Hwu
(74) *Attorney, Agent, or Firm*—Quintero Law Office

(57) ABSTRACT

A micro-droplet generator comprises a main body, having a chamber accommodating liquid to be sprayed and a lateral opening, a spraying plate, placed in the opening and having a plurality of spraying holes as well as an inner side, a vibrating element, glued on the spraying plate and driving vibrations thereof, and a projection, placed inside the chamber and having an outer side touch with the inner side of the spraying plate, wherein a narrow space is left between the inner side of the spraying plate and the outer side of the projection, which upon the vibrations of the spraying plate has a varying width, upon becoming wider sucking in liquid from the chamber, and upon becoming narrower pressing out liquid through the spraying holes.

11 Claims, 4 Drawing Sheets

MICRO-DROPLET GENERATOR

BACKGROUND OF THE INVENTION

1. Field of the Invention

The present invention relates to a micro-droplet generator, particularly to a micro-droplet generator which works by the piezoelectric effect, producing a well-defined flow of tiny droplets.

2. Description of Related Art

Currently available sprayers have two kinds, which work by direct pressure and by vibrations, generating pressure that disperses micro-particles. A common disadvantage of conventional sprayers is the need of large pressure when relatively large particles are generated, resulting in a large noise. For medical applications, spraying of relatively large particles is not required, but precise particle sizes are important. Therefore, sprayers working by vibration have recently been preferred for medical applications. Sprayers of this kind use ultrasound, generated by piezoelectric material, to produce micro-droplets. Shortcomings of these sprayers, however, are high power consumption, the need of a fan to drive micro-droplets into a given direction, a large volume, and non-uniform distribution of micro-particle sizes. Other sprayers which use piezoelectric material have spraying plates with holes of defined diameters to disperse micro-droplets, resulting in considerably reduced power consumption and well-defined micro-droplet sizes. Sprayers of this kind, disclosed in patent or sold on the market, are of two sub-kinds: Sprayers of the first sub-kind by direct vibrational pressure force micro-droplets through spraying plates, sprayers of the second sub-kind have vibrating spraying plates, causing micro-droplets to pass through. Sprayers of the first sub-kind have a higher power consumption than sprayers of the second sub-kind. The latter in some versions use planes that are tapped on, e.g., planes attached to capillary tubes transmitting liquid at ends thereof. These designs, however, have the following shortcomings:

1. Energy is easily dissipated.
2. Volume is large.
3. Manufacturing cost is high.
4. Tapped planes attached to capillaries allow only for small spraying angles.
5. Spraying is performed with limited effectiveness.

SUMMARY OF THE INVENTION

It is an object of the present invention to provide a micro-droplet generator allowing precise control of flow of micro-droplets.

Another object of the present invention is to provide a micro-droplet generator having a small volume and low manufacturing cost.

A further object of the present invention is to provide a micro-droplet generator having a flat shape.

The present invention can be more fully understood by reference to the following description and accompanying drawings.

DETAILED DESCRIPTION OF THE PREFERRED EMBODIMENTS

As shown in FIG. 1, the micro-droplet generator of the present invention mainly comprises: a main body 10; a spraying plate 20; a piezoelectric element 30; and an outer surface 41, which is formed on an projection body 40, which may be a projection or a plan plate. The main body 10 has an inner chamber 11, accommodating liquid to be sprayed. A lateral opening 12 in the main body 10 connects the chamber 11 with the outside and houses the spraying plate 20. Liquid to be sprayed passes through the opening 12.

The main body 10 further has an upper side with an inlet 13, through which liquid to be sprayed is poured into the chamber 11. For mobile applications, e.g., ambulant medicine, the chamber 11 is preferably sized large enough for repeated spraying. For stationary applications, e.g., indoor spraying of liquid from a fixed installed supply, the inlet 13 preferably has a fixed connection thereto.

As shown in FIG. 2, the spraying plate 20 is laid into the opening 12, having a center and a plurality of spraying holes 21 in a dense arrangement around the center. The spraying holes 21 define sizes and spraying directions of sprayed micro-droplets, allowing for precise control thereof.

As further shown in FIG. 2, the spraying plate 20 has an inner side 22 facing the chamber 11 and contacting liquid to be sprayed therein.

Referring again to FIGS. 1 and 2, the piezoelectric element 30 is made of piezoelectric material and placed on an opposite face to the inner side of the spraying plate. 20. Applying electric voltage to the piezoelectric element 30 causes vibrations thereof, driving vibrations of the spraying plate 20.

The piezoelectric element 30 and the spraying plate 20 are glued to each other. The spraying plate 20 and the opening 12 have round shapes, while the piezoelectric element 30 is shaped like a ring. As shown in FIGS. 3 and 4, when electric voltage is applied to the piezoelectric element 30, vibrations thereof are performed in a direction thereto.

The main characteristic of the present invention lies in the projection 40 being placed in the chamber 1. The projection 40 has an inner end attached to an inner wall of the main body 10 and an opposite outer end with an outer side 41 which is parallel to the inner side 22 of the spraying plate 20 and directly opposite to the center of the spraying plate 20 and the spraying holes 21 of the spraying plate 20, leaving a small space 50 in between.

When the piezoelectric element 30 is driving vibrations of the spraying plate 20, the space 50 has a varying width. As shown in FIG. 3, whenever the spraying plate 20 moves outward, away from the anvil surface 41 of the anvil body 40, the space 50 becomes wider, so that liquid flows into the space 50. On the other hand, when the spraying plate 20 moves inward, towards the anvil surface 41 of the anvil body 40, the space 50 becomes narrower, so that liquid is pressed against the anvil surface 41 and forced through the spraying plate 20, and micro-droplets 51 are generated.

Referring to FIGS. 5 and 6, liquid flow may be controlled by grooves cut into the anvil body 40. As shown in FIG. 5, a face groove 42 that is shaped like a closed loop is cut into the anvil outer surface 41 of a projection 40*a*. Thereby, as shown in FIG. 3, a minimum space between the outer surface 41 of the projection body 40 and the inner side 22 of the spraying plate 20 is maintained, in which liquid stays due to capillary forces. As shown in FIG. 6, at least one guiding groove 43 is cut into a periphery of the projection 40, due to capillary forces facilitating flow of liquid to the outer side 41 of the projection 40. By capillary forces liquid to be sprayed readily flows into the space 50, even against gravity forces.

A main characteristic of the present invention lies in installing of the projection body 40 in the chamber 11. As shown in FIGS. 3 and 4, placing the outer surface 41 of the projection body 40 close to the inner side 22 of the spraying plate 20 creates the narrow space 50, confining vibrational energy to a small volume, so that energy is saved and power consumption is low, allowing for battery use and prolonged use. Furthermore, effective transmission of vibrations of the spraying plate 20 to liquid inside the space 50 reduces required power for driving liquid through the spraying holes 21, allowing to reduce diameters thereof for a better spraying effect.

What is more, as compared to conventional art, the present invention has a simplified driving system without any need for auxiliary devices, so that manufacturing cost is kept low and volume is reduced. Thereby, mobile applications are readily supported and flat shapes are realizable, making the present invention suitable for applications in ambulant medical devices or air conditioners.

Figure 1:
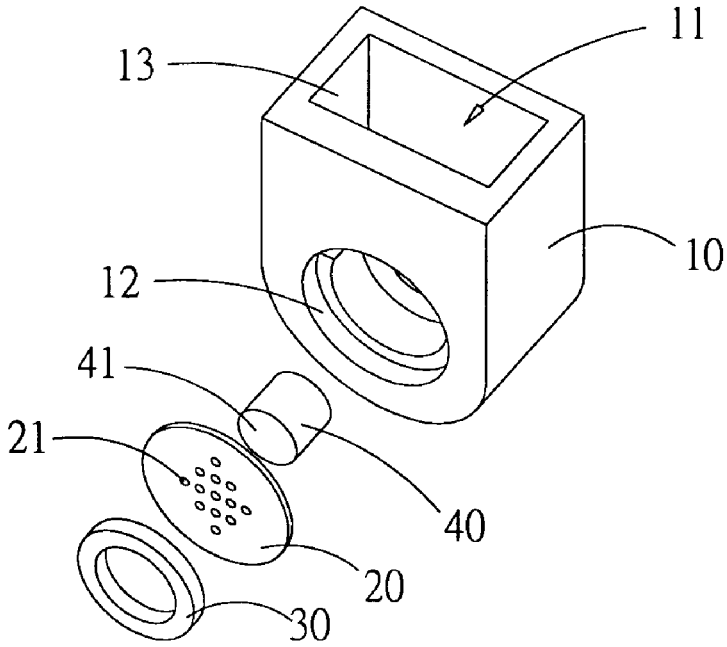
FIG. 1 is a perspective view of the micro-droplet generator of the present invention when disassembled.
Figure 2:
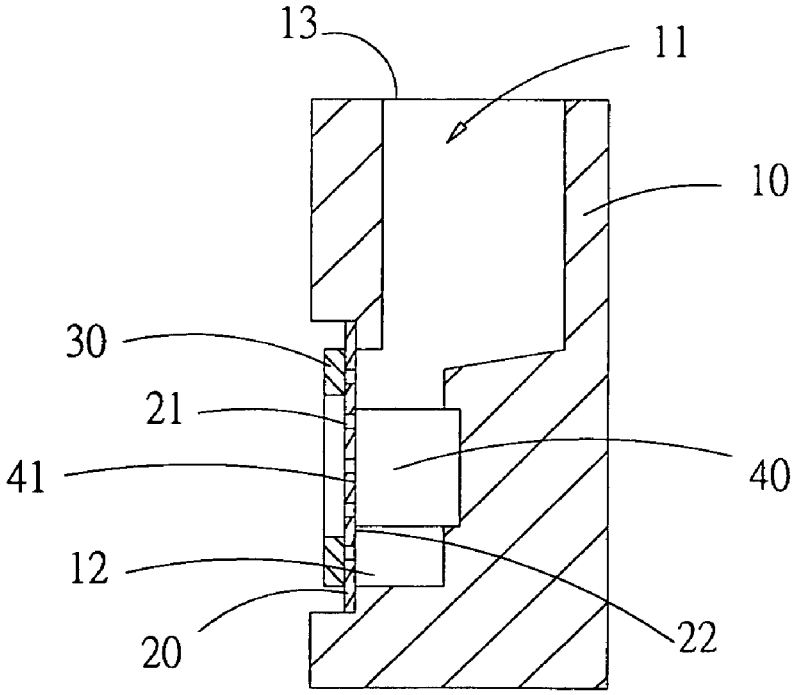
FIG. 2 is a sectional side view of the micro-droplet generator of the present invention.
Figure 3:
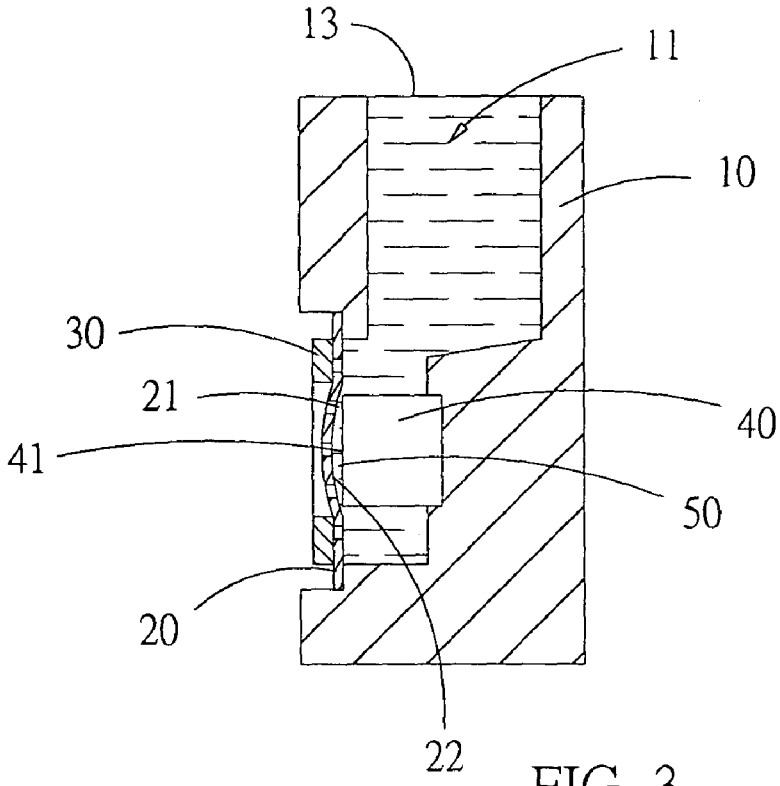
FIGS. 3 and 4 are schematic illustrations of the operation of the present invention.
Figure 4:
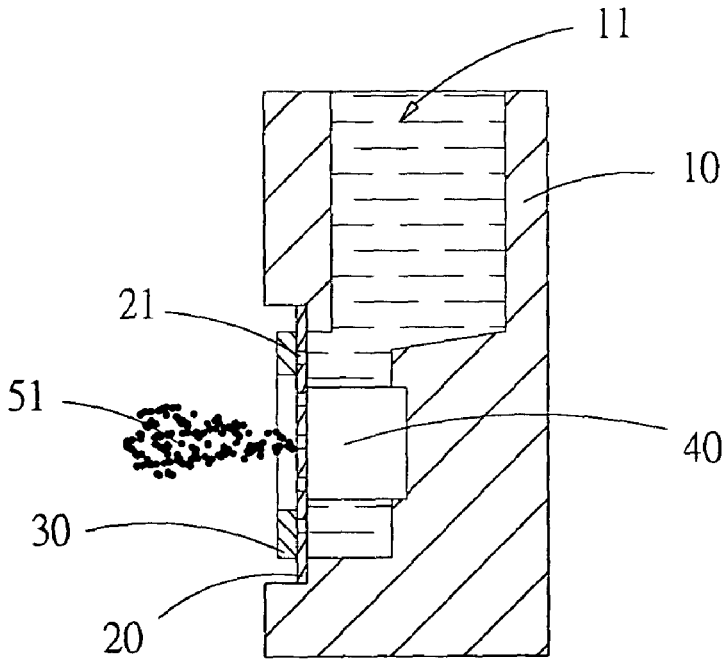
Figure 5:
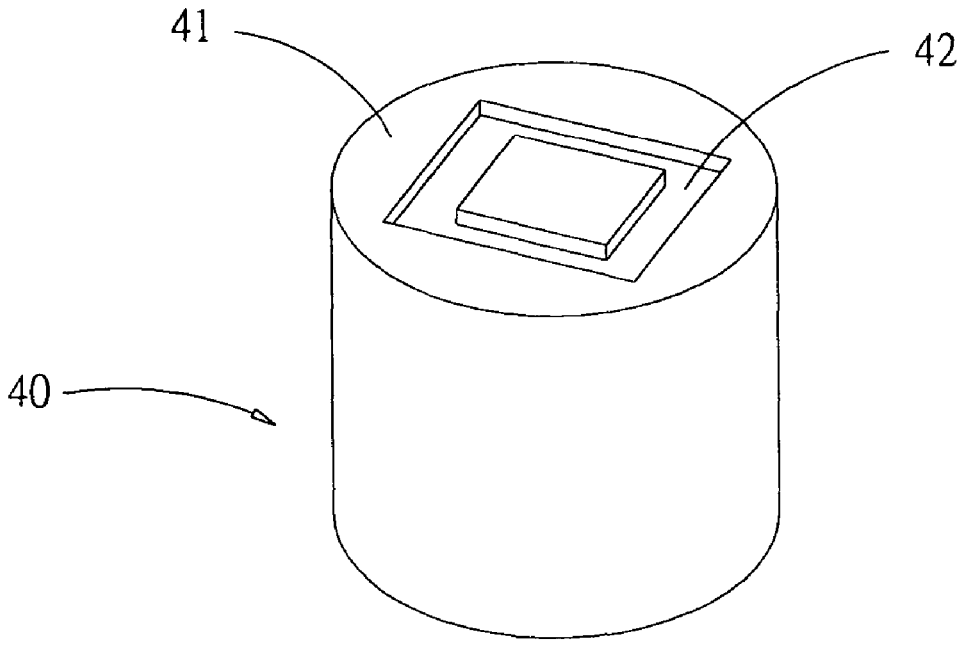
FIG. 5 is a perspective view of the projection of the present invention in another embodiment.
Figure 6:
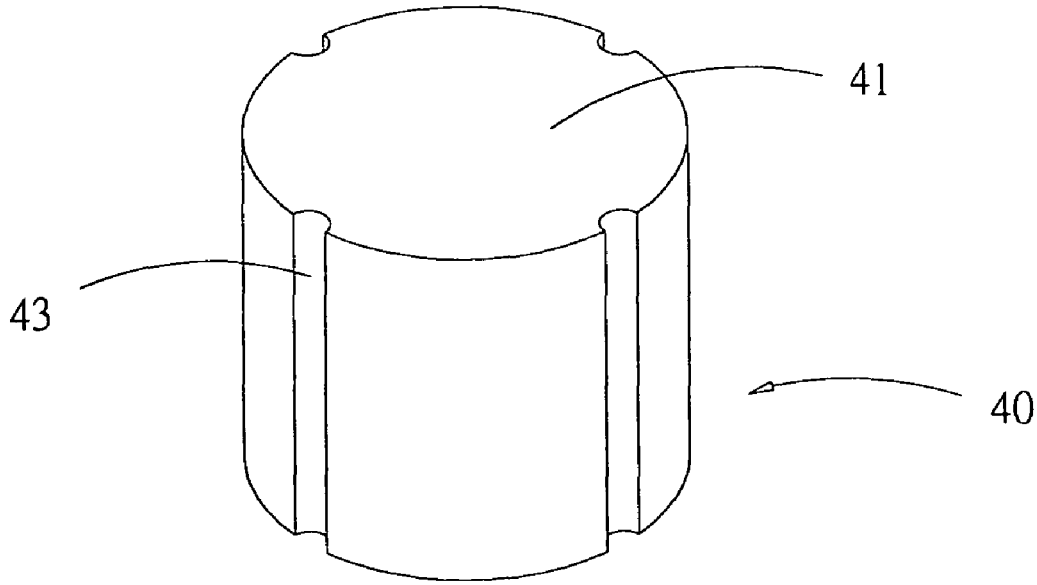
FIG. 6 is a perspective view of the projection of the present invention in a further embodiment.
Figure 7:
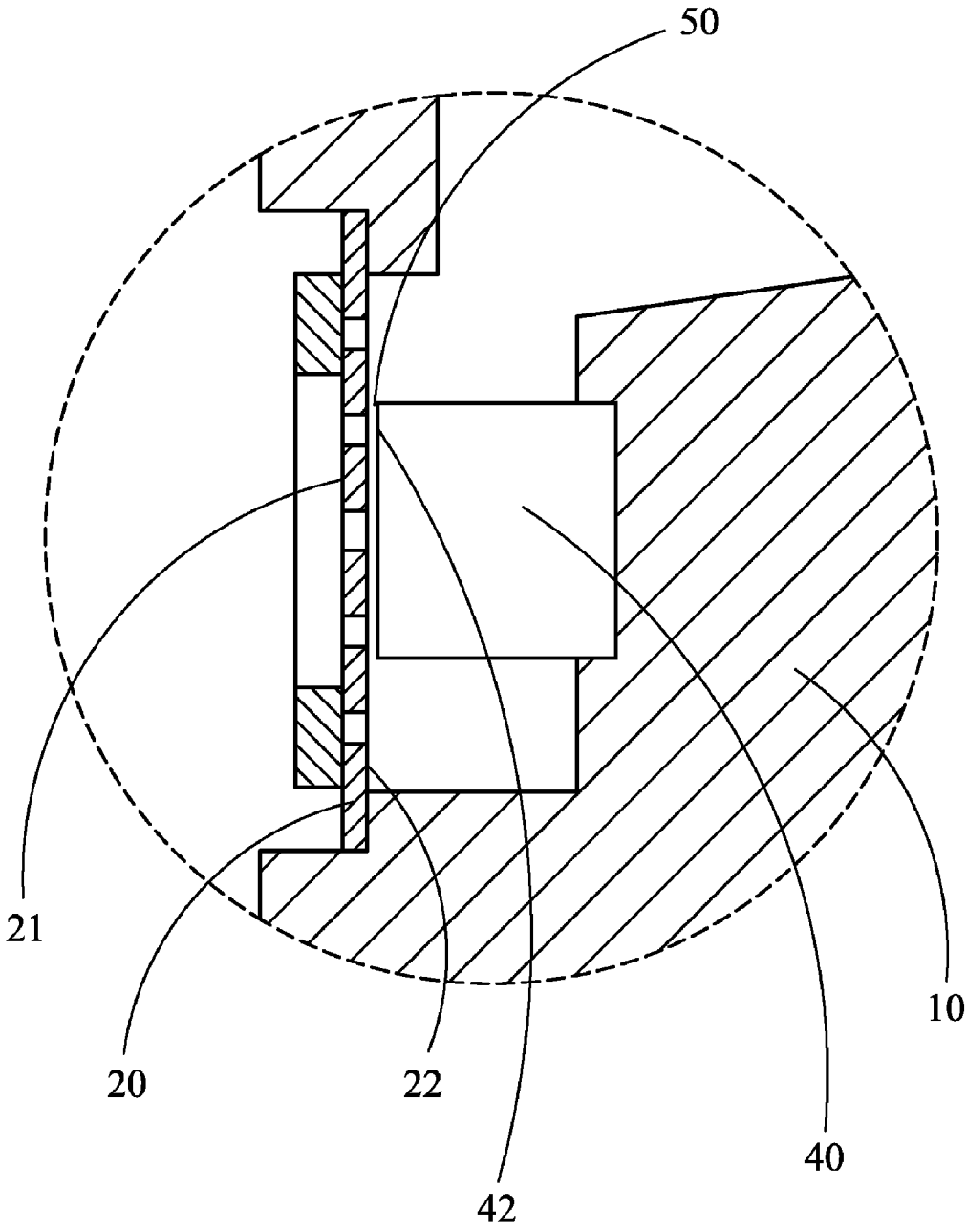
FIG. 7 is a large view of the spraying plate and the projection in FIG. 2.

The invention claimed is:

1. A micro-droplet generator, comprising:

a main body, having an inside with a chamber accommodating liquid to be sprayed and a lateral opening allowing liquid in said chamber to flow out;

a spraying plate, placed on said main body at said opening thereof and having a center and a plurality of spraying holes in a dense arrangement around the center as well as an inner side and an outer side, wherein the inner side is facing said chamber which contacts liquid in said chamber, and the outer side is facing away from said chamber;

a piezoelectric element, glued on the outer side of said spraying plate and driving vibrations thereof; and a substantially solid projection body, fixed to an inside surface of said chamber and extending into the midst of the liquid in the center of said chamber relative to said spraying plate so as to be aligned with said spraying holes, said substantially solid projection body having a planar outer surface parallel to said inner side of said spraying plate and directly opposite to the center of said spraying plate and said spraying holes of said spraying plate in a direction perpendicular to the planar outer surface, and separated by a narrow space from said inner side of said spraying plate;

wherein the narrow space upon said vibrations of said spraying plate has a varying width, upon becoming wider sucking in liquid from said chamber, and upon becoming narrower pressing out liquid through said spraying holes, so that effective spraying of liquid is performed.

2. The micro-droplet generator according to claim 1, wherein said main body has an upper side with an inlet through which liquid is poured into said chamber.

3. The micro-droplet generator according to claim 2, wherein said inlet is connected with a stationary supply of liquid, allowing liquid from there to enter said chamber.

4. The micro-droplet generator according to claim 1, wherein said piezoelectric element is made of piezoelectric material thereby vibrating upon application of electric voltage.

5. The micro-droplet generator according to claim 4, wherein said piezoelectric element is shaped like a ring, being attached to a circumference of said spraying plate.

6. The micro-droplet generator according to claim 1, wherein at least one guiding groove is cut into said projection, allowing liquid to reach said space between said inner side of said spraying plate and said outer side of said projection.

7. The micro-droplet generator according to claim 6, wherein said guiding groove is placed on a periphery of said projection.

8. The micro-droplet generator according to claim 1, wherein said face groove is shaped like a closed loop.

9. The micro-droplet generator according to claim 1, wherein said projection has an inner side fixed to said main body.

10. The micro-droplet generator according to claim 1, wherein said spraying plate is laid into said opening of said main body.

11. The micro-droplet generator according to claim 1, wherein said piezoelectric element drives vibrations of said spraying plate by common electric power.

* * * * *